United States Patent [19]

Döhler et al.

[11] Patent Number: 4,639,310

[45] Date of Patent: Jan. 27, 1987

[54] PROCESS FOR THE PRODUCTION OF REFORMER FEED AND HEATING OIL OR DIESEL OIL FROM COAL BY LIQUID-PHASE HYDROGENATION AND SUBSEQUENT GAS-PHASE HYDROGENATION

[75] Inventors: Werner Döhler, Marl; Ludwig Merz, Recklinghausen; Heinz Frohnert, Bottrop; Bernd Uckermann, Dortmund; Ulrich Graeser, Haltern; Alfons Jankowski, Essen; Eckard Wolowski, Mülheim-Ruhr; Hans-Friedrich Tamm, Recklinghausen; Norbert Wilczok, Mülheim, all of Fed. Rep. of Germany

[73] Assignee: Veba Oel Entwicklungs-Gesellschaft, Fed. Rep. of Germany

[21] Appl. No.: 761,681

[22] Filed: Aug. 2, 1985

[30] Foreign Application Priority Data

Aug. 4, 1984 [DE] Fed. Rep. of Germany ..... 3428783
May 4, 1985 [DE] Fed. Rep. of Germany ..... 3516084

[51] Int. Cl.[4] ..... C10G 1/00; C10G 1/06

[52] U.S. Cl. ..... 208/412; 208/413; 208/418; 208/429

[58] Field of Search ..... 208/10, 8 LE, 413, 412, 208/418, 429

[56] References Cited

U.S. PATENT DOCUMENTS

| | | | |
|---|---|---|---|
| 3,652,446 | 3/1972 | Dengler et al. | 208/10 |
| 3,755,137 | 8/1973 | Schuman | 208/10 |
| 3,892,654 | 7/1975 | Wright et al. | 208/8 LE |
| 4,045,328 | 8/1977 | Green et al. | 208/8 LE |
| 4,048,054 | 9/1977 | Green et al. | 208/431 |
| 4,111,788 | 9/1978 | Chervendz et al. | 208/10 |
| 4,123,347 | 10/1978 | Maa | 208/8 LE |
| 4,159,236 | 6/1979 | Schmid | 208/8 LE X |
| 4,189,371 | 2/1980 | Maa et al. | 208/8 LE |
| 4,222,844 | 9/1980 | Nizamoff | 208/431 |
| 4,300,996 | 11/1981 | Kuehler | 208/10 |
| 4,322,283 | 3/1982 | Maa et al. | 208/8 LE X |
| 4,330,389 | 5/1982 | Rosenthal et al. | 208/8 LE X |
| 4,330,391 | 5/1982 | Rosenthal et al. | 208/10 |
| 4,338,182 | 7/1982 | Vernon et al. | 208/8 LE |
| 4,400,263 | 8/1983 | Kydd et al. | 208/10 |
| 4,410,414 | 10/1983 | Briley | 208/8 LE |
| 4,452,688 | 6/1984 | Mitchell et al. | 208/8 LE X |
| 4,473,460 | 9/1984 | Küerten et al. | 208/10 |
| 4,485,008 | 11/1984 | Maa et al. | 208/10 |

*Primary Examiner*—Andrew H. Metz
*Assistant Examiner*—William G. Wright
*Attorney, Agent, or Firm*—Oblon, Fisher, Spivak, McClelland, & Maier

[57] ABSTRACT

A process for the production of reformer feed and heating or diesel oil from coal which comprises introducing a pulverized coal-oil slurry together with a hydrogenation gas into a liquid-phase hydrogenation stage; remoping solids-containing residue from the discharge from the liquid phase hydrogenation stage, cooling the resulting residue-free volatile coal-oil fraction from the discharge and, if necessary, removing a slurry oil fraction therefrom before feeding the volatile coal-oil fraction to a gas-phase hydrogenation stage; introducing fresh hydrogen which is substantially free of contaminants into the gas-phase hydrogenation stage together with the volatile coal-oil fraction, the fresh hydrogen introduced into the gas-phase hydrogenation stage constituting the entire amount of hydrogen required for the process; and utilizing the waste-gas from the gas-phase hydrogenation as the hydrogenation gas for the liquid-phase hydrogenation. By contrast with conventional processes, which during gas-phase hydrogenation requires operating partial pressures of 300 bars, the process of this invention makes possible the lowering of the operating pressures required during gas-phase hydrogenation to approx. 50–200 bars and also enables significantly reduced consumption of hydrogen.

17 Claims, 2 Drawing Figures

PROCESS FOR THE PRODUCTION OF REFORMER FEED AND HEATING OIL OR DIESEL OIL FROM COAL BY LIQUID-PHASE HYDROGENATION AND SUBSEQUENT GAS-PHASE HYDROGENATION

BACKGROUND OF THE INVENTION

1. Field of the Invention

This invention relates to a process for the production of reformer feed and heating oil or diesel oil from coal by means of liquid-phase hydrogenation and subsequent catalytic gas-phase hydrogenation.

2. Discussion of the Background

DE-PS No. 900 214 describes a process for removing extraneous gases from the circulation gas of a catalytic high-pressure hydrogenation process. In this process, the liquid reaction product of the gas phase reactor, without passing through special scrubbing equipment, is directly used as a scrubbing liquid for the circulating gas of the liquid phase system which has been contaminated by gaseous hydrocarbons, nitrogen and carbon monoxide. The liquid and gas-phase circuits are connected at the inlet and outlet sides of a circulation pump system and all of the hydrogen is introduced either into common circulation or into the gas-phase zone. In the latter case, the difference between the total gas requirement of the gas-phase zone and the added hydrogen, is removed from the outlet side of the common circulation system and is thus cleansed of impurities in the gas-phase.

This process certainly alleviates the requirement for an additional scrubbing system for the removal of impurities from the circulating gas. However, because of the presence of portions of the circulating hydrogen gas from the liquid-phase hydrogenation, optimal refining hydrogenation selectivity cannot be achieved during the gas phase hydrogenation stage. This necessitates using very high hydrogen pressures which results in greater hydrogen consumption.

Accordingly, there exists a strongly felt need for a better process for the production of reformer feed and heating oil or diesel oil from coal. Such a process should have high refining hydrogenation selectivity, should be run with lower operating pressures and should minimize the consumption of hydrogen.

SUMMARY OF THE INVENTION

Accordingly, it is an object of this invention to provide a novel process for the production of reformer feed and heating oil or diesel oil from coal in which the operating pressure used during the gas-phase hydrogenation has been lowered relative to prior art processes.

It is another object of this invention to provide a novel process for the production of reformer feed and heating oil or diesel oil where the consumption of hydrogen has been reduced.

These objects have now been surprisingly satisfied by the process for the production of reformer feed and heating or diesel oil from coal of this invention which is characterized as follows. A pulverized coal/oil slurry is introduced together with a hydrogenation gas into a liquid-phase hydrogenation stage. The solids-containing residue from the liquid-phase discharge is removed, and the resulting residue-free volatile coal-oil fraction from the discharge is cooled. At this point, if necessary, a slurry oil fraction is removed from the volatile coal-oil fraction. The volatile coal-oil fraction is then fed to a gas-phase hydrogenation stage. Fresh hydrogen which is substantially free from contaminants is introduced into the gas-phase hydrogenation stage together with the volatile coal-oil fraction. The fresh hydrogen introduced into the gas-phase hydrogenation stage constitutes the entire amount of hydrogen required for the process, and the waste-gas from the gas-phase hydrogenation is utilized as the hydrogenation gas for the liquid-phase hydrogenation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying figures, wherein.

DETAILED DESCRIPTION OF THE PREFERRED EMBODIMENTS

Figure 1:
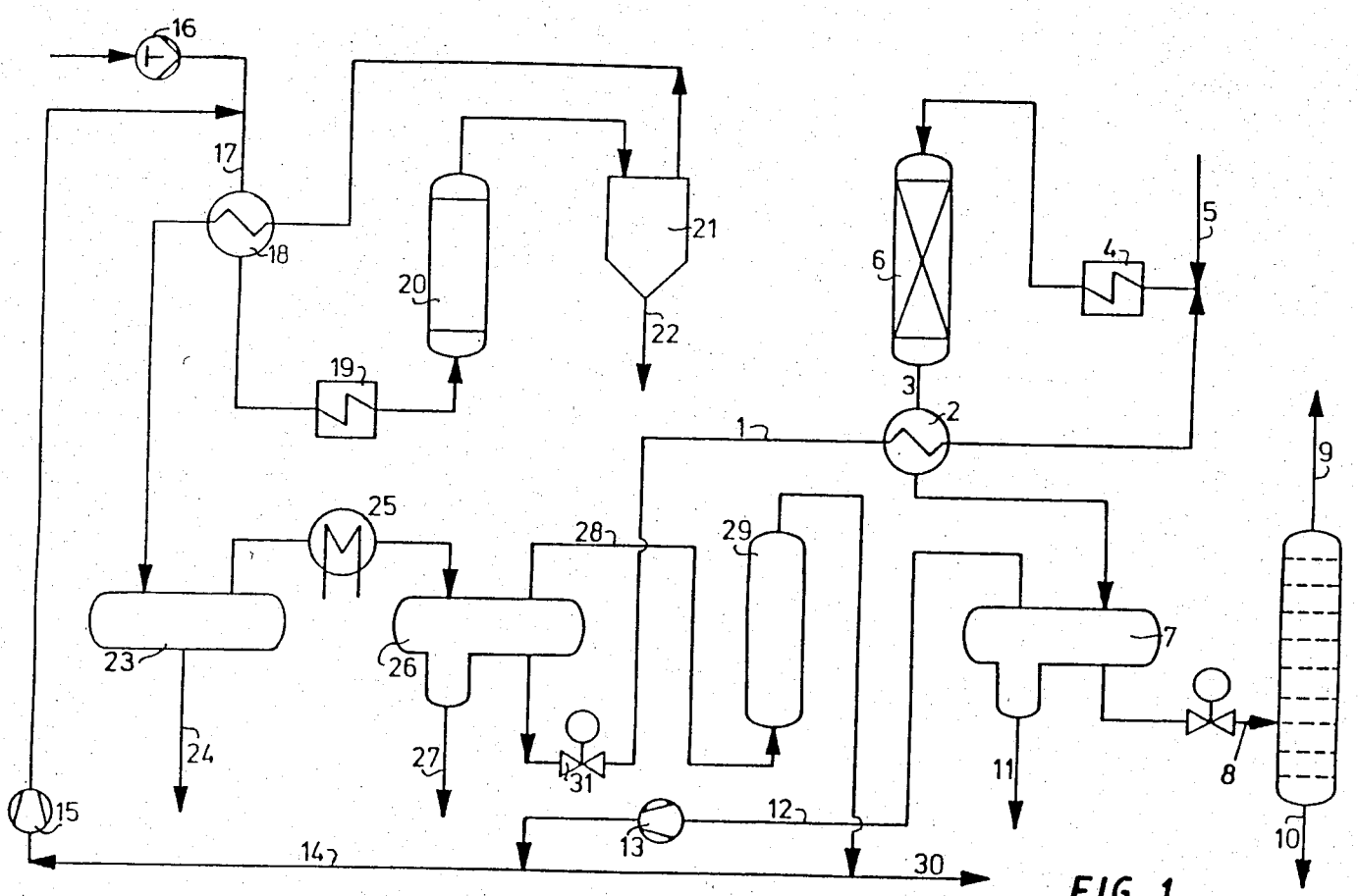
FIGS. 1 and 2 are flow charts illustrating preferred embodiments of the process of this invention.

By contrast with conventional processes which require operating partial pressures of 300 bars during the gas-phase hydrogenation, this invention makes possible the lowering of the operating pressures required during the gas-phase hydrogenation to approximately 50–200 bars. The present invention thus also enables a significant reduction in hydrogen consumption.

According to this invention, there is provided a process for the production of reformer feed and heating or diesel oil at elevated pressure and temperature. This process uses a liquid-phase hydrogenation stage coupled with a gas phase hydrogenation stage. A pulverized coal/oil slurry and a hydrogen gas are introduced to a liquid-phase hydrogenation stage. The solids-containing residue is removed from the discharge of the liquid-phase hydrogenation stage, and the residue-free volatile coal-oil fraction from the discharge is cooled. At this point, if necessary, a slurry oil fraction is removed from the volatile coal-oil fraction. The volatile coal-oil fraction is fed to a gas-phase hydrogenation stage. The total hydrogen required for the liquid and the gas-phase hydrogenations is first employed in the gas-phase hydrogenation stage as fresh hydrogen. This hydrogen is largely free of contaminants present in the circulating gas of coal hydrogenation systems—namely $H_2O$, $NH_3$, $H_2S$, CO, $CO_2$ and $C_1$ to $C_4$ gases. The residual gas from the gas-phase hydrogenation phase, containing for the most part unreacted hydrogen, is then employed as the hydrogenating gas for the liquid-phase hydrogenation.

It has been discovered that the waste-gas from the gas-phase hydrogenation is quantatively and qualitatively a suitable hydrogenating gas for the liquid-phase hydrogenation because it is entirely free of carbon monoxide, carbon dioxide, hydrogen sulfide and ammonia. The amount of hydrogen thus made available is sufficient to meet the theoretically required consumption in the liquid-phase hydrogenation.

Preferably, the total pressure in the gas-phase hydrogenation stage is arranged to be lower than the pressure of the liquid-phase hydrogenation.

The gas circulation circuit may be arranged so that it is possible to control the temperature of the gas-phase reactor. This is achieved by separating the entire flow of fresh hydrogen into one sub-portion which is directed to the gas-phase hydrogenation stage as a quench gas for temperature control.

When higher quality products requiring a higher level of hydrogen conversion and correspondingly greater exothermy during gas phase hydrogenation are required, the gas from the liquid-phase circulation may additionally be introduced into the gas-phase reactor as a quench gas. If desired, a portion of the hydrogenation waste-gas may be introduced as a quench gas into the gas-phase reactor or directed to the gas-phase feed. For this purpose, the gas phase may be fitted with its own gas circulation system.

The pressure in the gas-phase may be at least 50 bars lower than the operating pressure of the liquid-phase, i.e., the liquid-phase operates at a pressure of 100 to 400 bars while, the gas-phase operates at a pressure of from 50 to 200 bars.

The integrated refining process made possible by the present invention is characterized by a special circuit for the gas flow in the gas and liquid-phases, whilst a circulating gas system is provided for either in the liquid-phase alone or additionally in the gas-phase (which is nevertheless separate from the liquid phase). Fresh hydrogen is brought only to the gas phase hydrogenation. The process of this invention is further characterized by a significant reduction in the pressure required in the gas-phase hydrogenation as compared to conventional processes.

Although there are differences between different types of coal, the production and processing of 1 ton of coal-oil typically requires 2500 $m^3$ of hydrogen. At a ratio of hydrogen to oil of 2500 $m^3$/t coal-oil in the gas phase and a chemical consumption of hydrogen of, for example, 500 $m^3$ per ton of coal-oil, 2000 $m^3$ hydrogen (which is largely free from carbon monoxide and carbon dioxide and also contaminants such as hydrogen sulfide, ammonia and the like) can be transferred to the liquid phase hydrogenation so that the quantity of available hydrogen is still greater than that theoretically required for the liquid-phase hydrogenation.

The pure high-pressure hydrogen employed in the process of this invention, which does not contain the impurities $H_2O$, $NH_3$, $H_2S$, CO, $CO_2$ and the hydrogen partial pressure-reducing $C_1$ to $C_4$ gases generally found in coal-oil processing, ensures significantly greater catalyst selectivity in the gas-phase hydrogenation. The pressure reduction made possible by the invention during the gas-phase hydrogenation stage reduces the complexity of the technology required (and therefore the attendant investment costs) as compared with conventional state-of-the-art methods for coal-oil processing. The reduced pressure leads also to less complete hydrogenation of the coal-oil. The absence of CO and $CO_2$ impurities results in reduced hydrogen use, since these would be hydrogenated to hydrocarbons.

The light oil obtained from the process according to the invention is of reformer feed quality and, after reforming, possesses exceptional automotive qualities such as, for example, a high Research Octane Number as well as a high Motor Octane Number. The middle distillate fraction is suitable as a heating oil or diesel fuel.

Preferably, the ratio of hydrogen to coal-oil in the addition of fresh hydrogen to the gas-phase hydrogenation stage is approximately 1000 to 5000 and preferably 1500 to 3000 $m^3$/t of coal-oil.

The discharge of the gas phase hydrogenation may be cooled off in an energy-efficient manner through heat exchange with the incoming feed to the gas phase hydrogenation, whereby a corresponding heating of the feed takes place.

By removing the heat of hydrogenation and regulation of the heating-up of the fresh hydrogen and the coal-oil, the operating temperature can be kept constant.

Preferably, the discharge from the liquid-phase hydrogenation is cooled after removal of solids therefrom, through heat exchange with the feed slurry and further cooled after separation of the oil fraction used for slurrying the coal feed. Effluent containing ammonia and hydrogen sulfide is removed from the cooled gas which, aside from hydrogen, contains mostly carbon monoxide, carbon dioxide and volatile hydrocarbons. The gas is then subjected to an oil scrub at approximately 50° C. to room temperature at system pressure or at reduced pressure.

In order to more thoroughly remove dissolved gases from the coal-oil, the liquid coal-oil fraction can undergo a pressure reduction before the gas-phase hydrogenation. The liquid coal-oil fraction is then separated from the resulting gaseous components after which it can, if required, be brought up again to the pressure required for gas-phase hydrogenation.

Preferably, the circulating gas of the liquid-phase is preheated together with the feed slurry through heat exchange with the discharge from the liquid phase hydrogenation after separating out the solids-containing fraction.

Due to the use of fresh hydrogen in the gas-phase hydrogenation stage, a considerable reduction of process pressure is made possible. The so-called waste gas from the gas-phase hydrogenation meets the entire hydrogen requirement for the liquid-phase hydrogenation.

The invention will now be described further by way of example which are given for purposes of illustration of the invention and are not intended to be limiting thereof.

Referring now to the drawings, wherein like reference numerals designate identical or corresponding parts throughout the several views, and more particularly to FIG. 1 thereof, a pulverized coal-oil slurry is introduced to the system through a high pressure pump 16 and mixed with a hydrogenating gas circulating in a line 17. The mixture is pre-heated in a heat exchanger 18 and heated in an oven 19 before introduction to a reactor 20, where liquid-phase hydrogenation takes place.

The hydrogenation product passes to a high temperature separator 21 from which solids are removed through a line 22 and the solids-free component is passed through heat exchanger 18 where it is the heat exchange medium with the feed mixture to reactor 20 and is thus cooled. The solid-free component is then fed to an intermediate separator 23, from which effluent is removed through line 24, cooled to approximately 50° C. to room temperature in a heat exchanger 25 and fed to separator 26. Effluent is removed through line 27 and coal-oil through line 1, after partial pressure reduction by means of valve 31. The coal-oil is heated in a heat exchanger 2 and then mixed with fresh hydrogen entering through a line 5 in the ratio of 1250 $m^3$ of hydrogen to 0.05 t of coal-oil. The coal-oil/hydrogen mixture is passed through heater 4 and fed to gas-phase reactor 6, which contains a conventional Ni-Mo-Aluminum oxide catalyst. The hydrogenation product from reactor 6 is passed through heat exchanger 2 wherein it is the heating medium for the coal-oil in line 1, and is cooled thereby prior to introduction to a high pressure separator 7. From the separator 7, effluent is removed from line 11 and 0.49 t of refined product is fed through line 8 to a distillation stage, from which light oil to be used as reformer feed is obtained through line 9 and a heavy oil for use as heating or diesel oil is obtained through line 10.

The hydrogenation gas circulating in line 17 is derived from the high pressure separator 7 and from the separator 26. 1000 $m^3$ of residual gas from separator 7 are fed through line 12 to a compressor 13 and the compressed gas introduced into line 14. Gas from separator 26 is fed through a line 28 to a scrubber 29 and thence to line 14. A fraction of the hydrogenation gas comprising inert gases such as nitrogen and carbon monoxide is purged through line 30 in order that these gases do not accumulate in the circulating hydrogen and thus reduce the hydrogen partial pressure.

Figure 2:
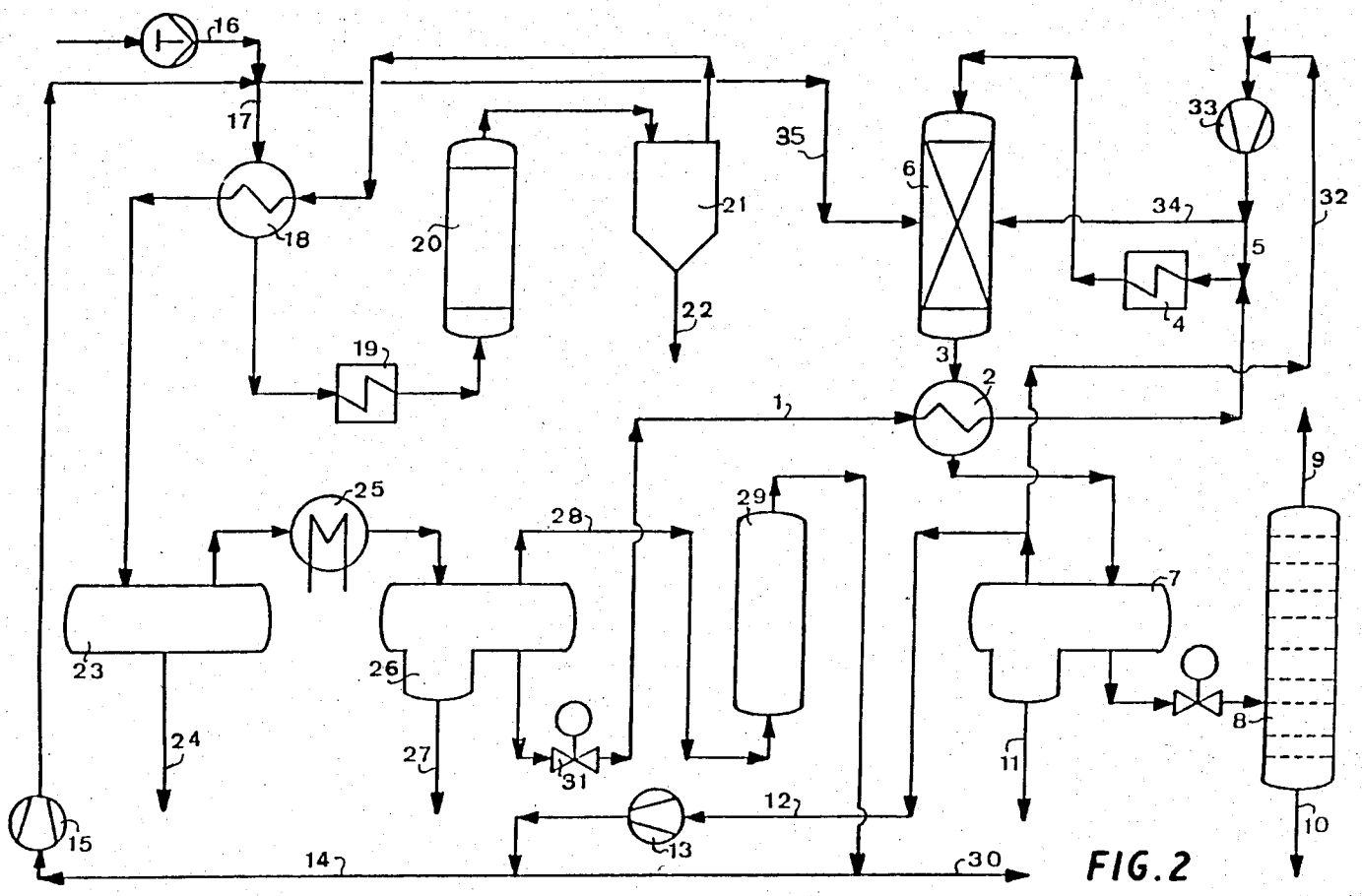

Referring now to FIG. 2, there is shown a further embodiment of the invention, which additionally includes a quench gas line 35 extending from the liquid-phase gas circuit to the gas-phase reactor; a recirculation line 32 for residual gas from the gas-phase phase reactor 6 exiting the high pressure separator 7 through line 12; a compressor 33 for the circulating gas in the gas-phase hydrogenation; and a quench gas line 34. Thus, quench gas derived from both the hydrogen feed and the residual gas from high pressure separator 7, as well as gas from the liquid-phase circulation, is introduced into gas phase hydrogenation reactor 6. In other respects, the circuit of FIG. 2 is identical to that of FIG. 1.

Obviously, numerous modifications and variations of the present invention are possible in light of the above teachings. It is therefore to be understood that within the scope of the appendend claims, the invention may be practice otherwise than as specifically described herein.

What is claimed as new and desired to be secured by Letters Patent of the United States is:

1. A process for the production of reformer feed and heating oil or diesel oil from coal, which comprises:

(i) introducing a pulverized coal-oil slurry together with a hydrogenation gas into a liquid-phase hydrogenation stage;

(ii) removing a solids-containing residue from the discharge of the said liquid-phase hydrogenation stage;

(iii) cooling the resulting residue-free volatile coal-oil fraction from the said discharge;

(iv) feeding the said volatile coal-oil fraction to a gas-phase hydrogenation stage;

(v) introducing fresh hydrogen which is substantially free of contaminants into the said gas-phase hydrogenation stage together with the said volatile coal-oil fraction, said fresh hydrogen introduced in the said gas-phase hydrogenation stage constituting the entire amount of hydrogen required for the said process; and (vi) utilizing the waste-gas from the said gas-phase hydrogenation as the hydrogenation gas for the said liquid-phase hydrogenation.

2. The process of claim 1, wherein after cooling the resulting residue-free volatile coal-oil fraction from the said discharge (step (iii)), a slurry-oil fraction is removed from the said residue-free volatile coal-oil fraction before feeding the said volatile coal-oil fraction to the said gas-phase hydrogenation stage (step (iv)).

3. The process of claim 1, wherein the said fresh hydrogen is heated together with the said coal-oil fraction from the said liquid-phase hydrogenation stage and is employed in the gas-phase hydrogenation stage in a ratio of hydrogen to coal-oil corresponding at least to the total hydrogen requirement in the liquid and gas phase hydrogenation stages, the total pressure of the gas-phase hydrogenation being lower than the pressure of the liquid-phase hydrogenation, the discharge of the said gas-phase hydrogenation being cooled under pressure and separated to provide a raffinate that is further separated into reformer feed and heating oil or diesel oil, and the remaining gaseous component after removal of effluent therefrom is fed into the circulating gas system of the liquid-phase hydrogenation after intermediate compression at the pressure level of the liquid phase hydrogenation, said volatile coal-oil fraction being cooled to a temperature between about 50° C. and room temperature before removal of effluent containing ammonia and hydrogen sulfide and heated with the said fresh hydrogen before introduction to the said gas-phase hydrogenation stage.

4. The process of claim 3, wherein after the said intermediate compression at a pressure level of the said liquid-phase hydrogenation, the said circulating gas is further heated with the feed slurry after separating out a portion of the effluent gas sufficient to maintain the partial pressure of the hydrogen and then fed to the liquid phase hydrogenation stage.

5. The process of claim 1, wherein the said fresh hydrogen is separated into a first portion as a feed for the gas-phase hydrogenation and a second portion for introduction of the gas-phase hydrogenation as a quench gas for temperature control.

6. The process of claim 5, wherein quench gas from the circulating gas system of the liquid-phase hydrogenation is fed into the gas-phase hydrogenation.

7. The process of claim 5, wherein for the purposes of recirculating a portion of the waste-gas from the said gas-phase hydrogenation gas and feeding the same as a quench gas from the gas-phase hydrogenation system, or feeding the same to the gas-phase hydrogenation stage as hydrogenation gas, the gas-phase hydrogenation stage is equipped with its own gas circulating circuit.

8. The process of claim 1, wherein the gas-phase hydrogenation operates with fresh hydrogen at a pressure which is at least 50 bars less than that of the liquid-phase hydrogenation.

9. The process of claim 1, wherein the said liquid-phase hydrogenation is carried out at a pressure of 100 to 400 bars, and the said gas-phase hydrogenation is carried out at a pressure of from 50 to 200 bars.

10. The process of claim 1, wherein in the gas-phase hydrogenation stage, hydrogen is employed in relation to coal-oil in a ratio of 1000 to 5000 $m^3/t$.

11. The process of claim 10, wherein the ratio is 1500 to 3000 $m^3/t$.

12. The process of claim 1, wherein the discharge from the gas-phase hydrogenation is cooled by means of a heat exchange with the coal-oil being fed to the gas-phase hydrogenation.

13. The process of claim 3, wherein after removal of the residue-containing fraction from the discharge of the liquid-phase hydrogenation and subsequent to cooling and removal of the effluent containing ammonia and hydrogen sulfide, the circulating gas is subjected to oil scrubbing at system pressure or after pressure reduction.

14. The process of claim 1, wherein the liquid fraction appearing as coal-oil is, before being brought to the said gas-phase hydrogenation, further pressure-reduced for the purpose of removing dissolved gases.

15. The process of claim 14, wherein after removing dissolved gases, the said coal-oil is brought up to the pressure used for the said gas-phase hydrogenation.

16. The process of claim 1, wherein the circulating gas of the liquid-phase is heated together with the feed slurry by means of heat exchange with the discharge from the liquid-phase hydrogenation after separating out the solids containing residue.

17. A process for the production of a reformer feed and heating oil or diesel oil from coal, which comprises:

(i) introducing a pulverized coal-oil slurry together with a hydrogenation gas into a liquid-phase hydrogenation phase;

(ii) removing a solids-containing residue from the discharge of the said liquid-phase hydrogenation stage;

(iii) cooling the resulting residue-free volatile coal-oil fraction from the said discharge;

(iv) removing a slurry-oil fraction from the said residue-free volatile coal-oil fraction;

(v) feeding the said coal-oil fraction to gas-phase hydrogenation stage;

(vi) introducing fresh hydrogen which is substantially free of contaminants into the said gas-phase hydrogenation stage together with the said volatile coal-oil fraction, said fresh hydrogen introduced in the said gas-phase hydrogenation stage constituting the entire amount of hydrogen required for the said process, and wherein the said fresh hydrogen is heated together with the said coal-oil fraction from the said liquid-phase hydrogenation stage and is employed in the gas-hydrogenation stage in a ratio of hydrogen to coal-oil corresponding at least to the total hydrogen requirement in the liquid and gas-phase hydrogenation stages, the total pressure of the gas-phase hydrogenation being lower than the pressure of the liquid-hydrogenation;

(vii) cooling the discharge of the said gas-phase hydrogenation under pressure, and separating the same to provide a raffinate that is further separated into reformer feed and heating oil or diesel oil, wherein the remaining gaseous component after removal of effluent therefrom is fed into the circulating gas system of the liquid-hydrogenation after intermediate compression at the pressure level of the liquid-phase hydrogenation, said volatile coal-oil fraction being cooled to a temperature between about 50° C. and room temperature before removal of effluent containing ammonia and hydrogen sulfide, and heated with the said fresh hydrogen before introduction to the said gas-phase hydrogenation stage.

* * * * *